United States Patent [19]

Ray et al.

[11] 4,036,638

[45] July 19, 1977

[54] BINARY AMORPHOUS ALLOYS OF IRON OR COBALT AND BORON

[75] Inventors: Ranjan Ray, Morristown; Sheldon Kavesh, Whippany, both of N.J.

[73] Assignee: Allied Chemical Corporation, Morris Township, N.J.

[21] Appl. No.: 636,323

[22] Filed: Nov. 28, 1975

Related U.S. Application Data

[60] Division of Ser. No. 631,752, Nov. 13, 1975, abandoned, which is a continuation-in-part of Ser. No. 590,532, June 26, 1975.

[51] Int. Cl.[2] ..... C22C 38/00; C22C 19/07

[52] U.S. Cl. ..... 75/123 B; 75/170; 148/31.55

[58] Field of Search ..... 148/31.55, 31.57; 75/122, 134 F, 170, 171, 176, 123 B, 123 D

[56] References Cited

U.S. PATENT DOCUMENTS

| | | | |
|---|---|---|---|
| 3,856,513 | 12/1974 | Chen et al. | 75/170 |
| 3,871,836 | 3/1975 | Polk | 29/194 |

OTHER PUBLICATIONS

Ruhl, et al., "Splat Quenching of Iron-Nickel-Boron Alloys," Trans ASM, vol. 245, Feb. 1969, pp. 253-257.

Hansen, "Constitution of Binary Alloys," 2nd Ed., McGraw-Hill, 1958, pp. 249-252.

*Primary Examiner*—Arthur J. Steiner

*Attorney, Agent, or Firm*—David W. Collins; Ernest A. Polin

[57] ABSTRACT

Binary amorphous alloys of iron or cobalt and boron have high mechanical hardnesses and soft magnetic properties and do not embrittle when heat treated at temperatures employed in subsequent processing steps, as compared with prior art amorphous alloys. The alloys have the formula $M_aB_b$, where M is iron or cobalt, *a* ranges from about 75 to 85 atom percent and *b* ranges from 15 to 25 atom percent.

2 Claims, No Drawings

BINARY AMORPHOUS ALLOYS OF IRON OR COBALT AND BORON

This is a division of application Ser. No. 631,752, filed Nov. 13, 1975, now abandoned, which in turn is a continuation-in-part application of application Ser. No. 590,532, filed June 26, 1975.

BACKGROUND OF THE INVENTION

1. Field of the Invention

The invention is concerned with amorphous metal alloys and, more particularly, with amorphous metal alloys which include iron or cobalt plus boron.

2. Description of the Prior Art

Novel amorphous metal alloys have been disclosed and claimed by H. S. Chen and D. E. Polk in U.S. Pat. No. 3,856,513, issued Dec. 24, 1974. These amorphous alloys have the formula $M_aY_bZ_c$, where M is at least one metal selected from the group consisting of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, *a* ranges from about 60 to 90 atom percent, *b* ranges from about 10 to 30 atom percent and *c* ranges from about 0.1 to 15 atom percent. These amorphous alloys have been found suitable for a wide variety of applications, including ribbon, sheet, wire, powder, etc. Amorphous alloys are also disclosed and claimed having the formula $T_iX_j$, where T is at least one transition metal, X is at least one element selected from the group consisting of aluminum, antimony, beryllium, boron, germanium, carbon, indium, phosphorus, silicon at tin, *i* ranges from about 70 to 87 atom percent and *j* ranges from about 13 to 30 atom percent. These amorphous alloys have been found suitable for wire applications.

At the time these amorphous alloys were discovered, they evidenced mechanical properties that were superior to then-known polycrystalline alloys. Such superior mechanical properties included ultimate tensile strengths up to 350,000 psi, hardness values of about 600 to 750 DPH and good ductility. Nevertheless, new applications requiring improved magnetic, physical and mechanical properties and higher thermal stability have necessitated efforts to develop further specific compositions.

With regard to methods of preparation, two general methods exist for preparing the amorphous metal alloys. The first method consists of procedures wherein atoms are added to an aggregate essentially one atom at a time. Such deposition procedures include vapor deposition, electrodeposition, chemical (electroless) deposition and sputtering.

The second method consists of procedures involving rapid quenching of a melt. Examples of such procedures include the various well-known "splat" techniques and continuous quenching techniques such as disclosed by J. Bedell in U.S. Pat. Nos. 3,862,658 and 3,863,700 and by S. Kavesh in U.S. Pat. No. 3,881,540. This second method is generally limited to materials which may be quenched to the amorphous state at rates less than about $10^{10}$ ° C/sec and more usually at rates of about $10^5$ to $10^6$ ° C/sec, which are attainable in presently available apparatus. The first method is more broadly applicable to all classes of metallic materials.

It has been suggested that a high degree of compositional complexity is essential in order to form amorphous metal alloys by quenching from the melt. See, e.g., B. C. Giessen and C. N. J. Wagner, "Structure and Properties of Noncrystalline Metallic Alloys Produced by Rapid Quenching of Liquid Alloys," in *Liquid Metals-Chemistry and Physics*, S. Z. Beer, Ed., pp. 633–695, Marcel Dekker Inc., New York (1972) and D. Turnbull, Vol. 35, *Journale de Physique*, Colloque-4, pp. C4-1 - C4-10, 1974.

While some particular binary alloys of iron group metals have been made amorphous by some of the deposition methods, binary amorphous iron group alloys have not been reported by quenching form the melt.

SUMMARY OF THE INVENTION

In accordance with the invention, binary amorphous alloys of iron or cobalt and boron, which are prepared by quenching from the melt, have high mechanical hardnesses and soft magnetic properties. Further, these amorphous metal alloys do not embrittle when heat treated at temperatures employed in subsequent processing steps. The amorphous alloys consist essentially of the composition $M_aB_b$, where M is one element selected from the group consisting of iron and cobalt, *a* ranges from about 75 to 85 atom percent and *b* ranges from about 15 to about 25 atom percent.

The amorphous metal alloys of the invention evidence tensile strengths ranging from about 470,000 to 610,000 psi, hardness values ranging from about 1000 to 1290 kg/mm$^2$, crystallization temperatures ranging from about 454° to 486° C and an elastic modulus of about $23 \times 10^6$ to $26 \times 10^6$ psi (in a saturating magnetic field). The saturation magnetization ranges from about 10.8 to 16.1 kGauss, the coercive force is less than 0.1 Oe, the core loss of many of these alloys is about 0.33 watt/kg (at 1000 Hz and 1000 Gauss) and the ratio of $B_r/B_s$ is about 0.5.

The alloys of this invention are at least 50% amorphous, and preferably at least 80% amorphous and most preferably about 100% amorphous, as determined by X-ray diffraction.

The amorphous alloys in accordance with the invention are fabricated by a process which comprises forming a melt of the desired composition and quenching at a rate of at least about $10^{5°}$ C/sec by casting molten alloy onto a chill wheel or into a quench fluid. Improved physical and mechanical properties,, together with a greater degree of amorphousness, are achieved by casting the molten alloy onto a chill wheel in a partial vacuum having an absolute pressure of less than about 5.5 cm of Hg.

DETAILED DESCRIPTION OF THE INVENTION

There are many applications which require that an alloy have, inter alia, a high ultimate tensile strength, high thermal stability and ease of fabricability. For example, metal ribbons used in razor blade applications usually undergo a heat treatment of about 370° C for about 30 min to bond an applied coating of polytetrafluoroethylene to the metal. Likewise, metal strands used as tire cord undergo a heat treatment of about 160° to 170° C for about 1 hr to bond tire rubber to the metal.

When crystalline alloys are employed, phase changes can occur during heat treatment that tend to degrade the physical and mechanical properties. Likewise, when amorphous alloys are employed, a complete or partial transformation from the glassy state to an equilibrium or a metastable crystalline state can occur during heat treatment. As with inorganic oxide glasses, such a transformation degrades physical and mechanical properties such as ductility, tensile strength, etc.

The thermal stability of an amorphous metal alloy is an important property in certain applications. Thermal stability is characterized by the time-temperature transformation behavior of an alloy, and may be determined in part by DTA (differential thermal analysis). As considered here, relative thermal stability is also indicated by the retention of ductility in bending after thermal treatment. Alloys with similar crystallization behavior as observed by DTA may exhibit different embrittlement behavior upon exposure to the same heat treatment cycle. By DTA measurement, crystallization temperatures, $T_c$, can be accurately determined by slowly heating an amorphous alloy (at about 20° to 50° C/min) and noting whether excess heat is evolved over a limited temperature range (crystallization temperature) or whether excess heat is absorbed over a particular temperature range (glass transition temperature). In general, the glass transition temperature $T_g$ is near the lowest, or first, crystallization temperature, $T_{c1}$, and, as is convention, is the temperature at which the viscosity ranges from about $10^{13}$ to $10^{14}$ poise.

Most amorphous metal alloy compositions containing iron, nickel, cobalt and chromium which include phosphorus, among other metalloids, evidence ultimate tensile strengths of about 265,000 to 350,000 psi and crystallization temperatures of about 400° to 460° C. For example, an amorphous alloy have the composition $Fe_{76}P_{16}C_4Si_2Al_2$ (the subscripts are in atom percent) has an ultimate tensile strength of about 310,000 psi and a crystallization temperature of about 460° C, an amorphous alloy having the composition $Fe_{30}Ni_{30}Co_{20}P_{13}B_5Si_2$ has an ultimate tensile strength of about 265,000 psi and a crystallization temperature of about 415° C, and an amorphous alloy having the composition $Fe_{74.3}Cr_{4.5}P_{15.9}C_5B_{0.3}$ has an ultimate tensile strength of about 350,000 psi and a crystallization temperature of 446° C. The thermal stability of these compositions in the temperature range of about 200° to 350° C is low, as shown by a tendency to embrittle after heat treating, for example, at 250° C for 1 hr or 300° C for 30 min or 330° C for 5 min. Such heat treatments are required in certain specific applications, such as curing a coating of polytetrafluoroethylene on razor blade edges or bonding tire rubber to metal wire strands.

The magnetic properties of amorphous alloys similar to the foregoing prior art compositions include saturation magnetization values ranging from about 6 to 15 kGauss, coercive forces ranging from about 0.03 to 0.19 Oe, Curie temperatures ranging from about 292° to 400° C, a ratio of remanent magnetization to saturation magnetization ($B_r/B_s$) of about 0.4 and a core loss of about 0.6 to 2 watt/kg (at 1000 Hz and 1000 Gauss).

In accordance with the invention, binary amorphous alloys of iron or cobalt and boron have high mechanical hardness and soft magnetic properties. These amorphous metal alloys do not embrittle when heat treated at temperatures typically employed in subsequent processing steps. These amorphous metal alloys consist essentially of the composition $M_aB_b$, where M is iron or cobalt, $a$ ranges from about 75 to 85 atom percent and $b$ ranges from about 15 to 25 atom percent. Examples of amorphous alloy compositions in accordance with the invention include $Fe_{75}B_{25}$, $Fe_{80}B_{20}$, $Fe_{83}B_{17}$ and $Co_{80}B_{20}$. The purity of all compositions is that found in normal commercial practice.

The amorphous metal alloys in accordance with the invention typically evidence ultimate tensile strengths ranging from about 470,000 to 610,000 psi, hardness values ranging from about 1000 to 1290 kg/mm$^2$ and crystallization temperatures ranging from about 454° to 486° C. These amorphous metal alloys are also among the stiffest glasses to date, evidencing an elastic modulus of about $23\times10^6$ to $26\times10^6$ psi in a saturating magnetic field.

The magnetic properties of these amorphous metal alloys are also unusual. For example, the saturation magnetization ranges from about 10.8 KGauss for $Co_{80}B_{20}$ to 16.1 kGauss for $Fe_{80}B_{20}$. The coercive force is less than 0.1 Oe in the as-cast condition. The ratio of $B_r/B_s$ is about 0.5. The core loss of $Fe_{80}B_{20}$ is about 0.33 watt/kg at 1000 Hz and 1000 Gauss. This compares favorably with commercial iron-silicon, which has a core loss of 0.26 watt/kg under the same condition. As a consequence of the unusual combination of high mechanical hardness and the soft magnetic properties, these alloys are useful as transformer cores and toroids.

A further surprising result is that the amorphous alloys of the invention can be formed by cooling a melt at a rate of at least about $10^{5°}$ C/sec. A variety of techniques are available, as is now well-known in the art, for fabrication splat-quenched foils and rapid-quenched continuous ribbons, wire, sheet, etc. Typically a particular composition is selected, powders of the requisite elements (or of materials that decompose to form the elements, such as ferroboron, etc.) in the desired proportions are melted and homogenized, and the molten alloy is rapidly quenched either on a chill surface, such as a rotating cooled cylinder, or in a suitable fluid medium, such as a chilled brine solution. The amorphous alloys may be formed in air. However, superior mechanical properties are achieved by forming these amorphous alloys in a partial vacuum with absolute pressure less than about 5.5 cm of Hg, and preferably about 100 $\mu$m to 1 cm of Hg, as disclosed in a patent application of R. Ray et al., Ser. No. 552,673, filed Feb. 24, 1975.

The amorphous metal alloys are at least 50% amorphous, and preferably at least 80% amorphous, as measured by X-ray diffraction. However, a substantial degree of amorphousness approaching 100% amorphous is obtained by forming these amorphous metal alloys in a partial vacuum. Ductility is thereby improved, and such alloys possessing a substantial degree of amorphousness are accordingly preferred.

The amorphous metal alloys of the present invention evidence superior fabricability and improved resistance to embrittlement after heat treatment compared with prior art compositions.

These compositions remain amorphous at heat treating conditions under which amorphous alloys containing phosphorus as one of several metalloids tend to embrittle. Ribbons of these alloys find use in magnetic applications and in applications requiring relatively high thermal stability and increased mechanical strength.

EXAMPLES

Rapid melting and fabrication of amorphous strips of ribbons of uniform width and thickness from high melting (about 1300° to 1400° C) reactive alloys was accomplished under vacuum. The application of vacuum minimized oxidation and contamination of the alloy during melting or squirting and also eliminated surface damage (blisters, bubbles, etc.) commonly observed in strips processed in air or inert gas at 1 atm. A copper cylinder was mounted vertically on the shaft of a vacuum rotary feedthrough and placed in a stainless steel vacuum chamber. The vacuum chamber was a cylinder flanged at two ends with two side ports and was connected to a diffusion pumping system. The copper cylinder was rotated by variable speed electric motor via the feedthrough. A crucible surrounded by an induction coil assembly was located above the rotating cylinder inside the chamber. An induction power supply was used to melt alloys contained in crucibles made of fused quartz, boron nitride, alumina, zirconia or beryllia. The amorphous ribbons were prepared by melting the alloy in a suitable non-reacting crucible and ejecting the melt by over-pressure of argon through an orifice in the bottom of the crucible onto the surface of the rotating (about 1500 to 2000 rpm) cylinder. The melting and squirting were carried out in a partial vacuum of about 100 μm, using an inert gas such as argon to adjust the vacuum pressure.

Using the vacuum-melt casting apparatus described above, a number of various glass-forming iron group-boron base alloys were chill cast as continuous ribbons having substantially uniform thickness and width. Typically, the thickness ranged from 0.001 to 0.003 inch and the width ranged from 0.05 to 0.12 inch. The ribbons were checked for amorphousness by X-ray diffraction and DTA. Hardness (DPH) was measured by the diamond pyramid technique, using a Vickers-type indenter consisting of a diamond in the form of a square-based pyramid with an included angle of 136° between opposite face. Tensile tests to determine ultimate tensile strength (in psi) were carried out using an Instron machine. The mechanical behavior of amorphous metal alloys having compositions in accordance with the invention was measured as a function of heat treatment. Magnetic properties were measured with conventional d.c. hysteresis equipment and with a vibrating sample magnetometer. All alloys were fabricated by the process given above. The amorphous ribbons of the alloys were all ductile in the as-quenched condition.

1. MECHANICAL PROPERTIES

The hardness (in kg/mm²), ultimate tensile strength (in psi) and crystallization temperature (in °C) of several of the amorphous metal alloys are listed in Table I below.

TABLE I

| Alloy Composition (Atom Percent) | Hardness (kg/mm²) | Ultimate Tensile Strength* (psi) | Crystallization Temperature (° C) |
|---|---|---|---|
| $Fe_{83}B17$ | 1000 | 470,000 | 466 |
| $Fe_{80}B20$ | 1100 | 525,000 | 465 |
| $Fe_{78}B22$ | 1248 | 590,000 | 454 |
| $Fe_{77}B23$ | 1230 | 585,000 | 456 |
| $Fe_{76}B24$ | 1283 | 605,000 | 476 |
| $Fe_{75}B25$ | 1290 | 610,000 | 486 |

*Calculated from hardness data.

The density of these alloys was about 7.4 g/cm³. The elastic modulus, measured in a saturating magnetic field, ranged from $23\times10^6$ psi for $Fe_{83}B_{17}$ to $25.7\times10^6$ for $Fe_{75}B_{25}$.

2. MAGNETIC PROPERTIES

The saturation magnetization ($4\pi M_s$), coercive force of a strip under d.c. conditions and Curie temperature were measured on a number of the amorphous metal alloys. These results are listed in Table II below. The saturation magnetization values are at room temperature unless otherwise specified.

TABLE II

| Alloy Composition (Atom Percent) | Magnetization, $4\pi Ms$ | Coercive Force (Oe) | Curie Temperature (° C) |
|---|---|---|---|
| $Fe_{83}B17$ | 194.5* | | |
| $Fe_{80}B20$ | 189.5* | | |
| | 16.1 kGauss | 0.08 | 377 |
| $Fe_{77}B23$ | 179.8* | | |
| $Co_{80}B20$ | 10.8 kGauss | 0.09 | 492 |

*Measured at 4.2° K; units are emu/g.

Saturation magnetostriction values were $+25\times10^{-6}$ for $Fe_{80}B_{20}$ and $-4.3\times10^{-6}$ for $Co_{80}B_{20}$. The magnetic properties of these amorphous metal alloys compare favorably with those of prior art amorphous metal alloys such as $Fe_{80}P_{14}B_6$, which has a saturation magnetization of 14.9 kGauss and a coercive force of 0.08 Oe.

What is claimed is:

1. A binary amorphous metal alloy that is about 100% amorphous having high mechanical hardness of at least about 1000 kg/mm², a tensile strength of at least about 470,000 psi and an elastic moduli of at least about $23\times10^6$ psi (in a saturating field), a saturation magnetization of at least about 10.8 kGauss and a coercive force less than about 0.1 Oe, characterized in that the alloy consists of the binary composition $M_aB_b$, where M is one element selected from the group consisting of iron and cobalt, B is boron, *a* ranges from about 75 to 85 atom percent and *b* ranges from about 15 to 25 atom percent.

2. The amorphous metal alloy of claim 1 in which the alloy consists essentially of a composition selected from the group consisting of $Fe_{83}B_{17}$, $Fe_{80}B_{20}$, $Fe_{78}B_{22}$, $Fe_{77}B_{23}$, $Fe_{76}B_{24}$, $Fe_{75}B_{25}$ and $Co_{80}B_{20}$.

* * * * *